United States Patent [19]

Bower

[11] 4,416,308

[45] Nov. 22, 1983

[54] FLEXIBLE ONE-WAY VALVE AND METHOD OF PRODUCING

[76] Inventor: James F. Bower, 7598 Frazer Dr., Riverside, Calif. 92509

[21] Appl. No.: 364,224

[22] Filed: Apr. 1, 1982

Related U.S. Application Data

[63] Continuation of Ser. No. 98,735, Nov. 30, 1979, abandoned.

[51] Int. Cl.[3] ..... F16K 15/14

[52] U.S. Cl. ..... 137/846; 383/57

[58] Field of Search ..... 137/844, 846; 150/9

[56] References Cited

U.S. PATENT DOCUMENTS

| | | | |
|---|---|---|---|
| 2,594,318 | 4/1952 | Langdon | 137/846 X |
| 2,662,724 | 12/1953 | Kravagna | 137/847 |
| 3,133,696 | 5/1964 | Mirando | 137/846 X |
| 3,282,412 | 11/1966 | Corella | 150/9 |
| 3,331,421 | 7/1967 | Lambert | 150/9 |
| 3,491,791 | 1/1970 | Polk | 137/844 |
| 3,822,720 | 7/1974 | Souza | 137/846 |

FOREIGN PATENT DOCUMENTS

| | | | |
|---|---|---|---|
| 1520354 | 3/1977 | United Kingdom | 137/846 |

*Primary Examiner*—Robert G. Nilson

*Attorney, Agent, or Firm*—Robert E. Browne; Alan L. Barry

[57] ABSTRACT

A flexible one-way valve is produced by cutting two flexible members having identical peripheral configurations and a maximum width intermediate opposite ends and the peripheral edges are secured to each other to produce valve portion having an inlet opening along the point of maximum width, an outlet opening at one end. The remainder of the peripheral edges are left unattached so that the unattached portions define a support which can extend perpendicular to the axis of the valve. The valve portion preferably has a reduced area opening or throat between the inlet opening and the outlet opening.

5 Claims, 9 Drawing Figures

PRIOR ART

FLEXIBLE ONE-WAY VALVE AND METHOD OF PRODUCING

This application is a continuation of U.S. Ser. No. 98,735, filed Nov. 30, 1979, now abandoned.

DESCRIPTION

1. Technical Field

The present invention relates generally to flexible containers and more particularly to an improved one-way valve for closing an open end of a container, such as a flexible bag. More specifically, the present invention is related to a one-way valve for a disposable flexible bag to accommodate insertion of solid or liquid materials into the bag and prevent the materials from being removed from the bag through the flexible valve.

2. Background Prior Art

The use of flexible polyethylene disposable bags has been common for many years and bags of this type are used in various areas, such as private homes, hospitals and other commercial institutes. Conventionally, such a plastic bag is formed from a single layer of flexible polyethylene which is folded in the middle and is sealed along opposite adjacent edges to produce an open top and a sealed bottom. In many instances it may be desirable to close the opened end of the bag with some type of valve that will allow material to be inserted into the bag and prevent the material from flowing out through the valve.

Numerous examples of several types of valves are disclosed in the following U.S. Pat. Nos. 683,897; 689,453; 2,564,462; 3,144,197; 3,189,252; 3,331,421; and 3,797,734.

The most common, and cheapest, type of valve that can be used for a polyethylene bag of the type referred to above consists of forming an integral extension on the upper open end of the bag and producing a reducing taper on the extension by sealing peripheral edges of the bag and then inverting the valve portion into the bag to produce a one-way valve. This type of valve construction is disclosed in U.S. Pat. Nos. 3,189,252; 3,331,421 and 3,797,734. The one-way valve of the type disclosed in the patents referred to above and illustrated in FIG. 7 have several disadvantages. One of the basic disadvantages of bags of the type having an integral extension on the end of the flexible bag is that if the bag is inverted the contents may force the valve out of the bag and the contents will spill out. This problem becomes even more acute when the bag is at least partially filled and inverted.

In order to avoid this type of problem, it has been proposed to reduce the size of the valve and make it comparatively small as compared to the opening in the bag (FIG. 9). However, with a reduced size valve of this type, the amount and type of material that can be inserted is limited and the bag cannot be completely filled because of the reduced diameter valve. Another alternative is to lengthen the valve flap (see FIG. 8) so that it extends a substantial distance into the bag type sleeve. However, this again reduces the amount of material that can be placed in the bag and also makes it impracticable for introducing solid materials into the bag.

One of the significant disadvantages of the inverted bag type valve discussed above, is the fact that as the bag becomes filled, the conventional polyethylene flexible bag has a tendency to spread along the outer open edge, which also is the inlet to the valve, and will produce a pressure on the valve along a plane that is perpendicular to the axis of the bag and the valve opening which causes the valve to open and enables the contents to pass therethrough. Another problem with most commercial types of valves is the fact that the bag must be in an upright position in order to insert the contents and retain the contents therein.

SUMMARY OF THE INVENTION

According to the present invention, a unique valve construction has been developed which is uneffected by forces that may be applied perpendicular to the plane of the valve and is easily accessable for inserting both solid and liquid material. The valve is constructed such that the container can be filled to its capacity and can be inverted without the contents spilling out of the inverted bag.

According to the present invention, the flexible one-way valve consists of two flexible members that have essentially identical peripheral edges and opposite ends with a portion of the peripheral edges being sealed to each other to define the valve portion which has an outlet opening adjacent one end and an inlet opening spaced from the end. The remainder of the peripheral edges of the two members are unattached and are adapted to extend perpendicular to the valve portion and act as a valve support. The peripheral edges of the valve support are designed to be sealed to the open peripheral edge of a flexible bag or sleeve and the support portion has a dimension that is essentially equal to the maximum opening on the sleeve type bag.

In one form of the invention, the valve portion has a reducing taper between the inlet and the outlet and the support portion of the bag is preferably substantially circular. In another version of the invention, the sealed peripheral edges extend inwardly along the plane defined by the support portion of the valve to define a reduced inlet opening along the plane of the support portion and the remainder of the sealed peripheral edges are arcuate and flare toward each other. Thus, the arcuate flared portions define a maximum inlet opening adjacent the plane, a reduced throat intermediate the inlet and an outlet opening slightly larger than the throat opening. In a third version of the invention, the peripheral sealed edge portions are again directed towards each other along the plane to define a reduced inlet opening along the plane, and the sealed peripheral or marginal edges taper toward each other, a portion of the distance between the inlet and the outlet and taper away from each other the remaining distance, to produce a reduced throat intermediate the inlet and the outlet.

In all versions of the invention, the edges of the two flexible members defining the outlet for the valve can have integral enlarged portions to increase the sealing ability for the valve.

The method aspect of the invention consists of cutting two flexible members to identical configurations, sealing a portion of the peripheral edges of the two members to produce a valve portion having an inlet and an outlet and leaving the remaining portion of the two members unattached to define a support portion for the valve. The peripheral edge of the two unattached portions of the two flexible members are then adapted to be attached to the peripheral edge of a bag or sleeve so that a support portion extends substantially perpendicular to the axis of the sleeve and the valve extends generally parallel to the axis.

BRIEF DESCRIPTION OF SEVERAL VIEWS OF DRAWINGS

Figure 7:
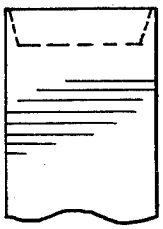
Figure 8:
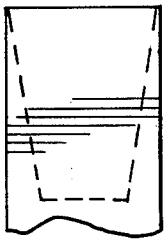
Figure 9:
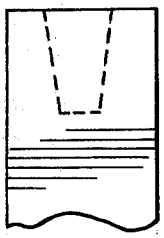

FIGS. 7, 8, and 9 disclose three different types of prior art one-way valves associated with the upper open end of the bag.

DETAILED DESCRIPTION

While this invention is susceptible of embodiment in many different forms, there is shown in the drawing and will herein be described in detail preferred embodiments of the invention with the understanding that the present disclosure to be considered as an exemplification of the principles of the invention and is not intended to limit the invention to the embodiments illustrated.

Figure 2:
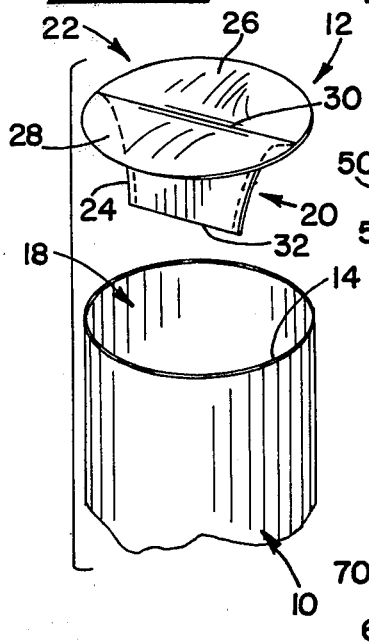
FIG. 2 is an exploded view of the valve and the top portion of the bag prior to having the valve sealed to the bag.

FIG. 2 of the drawings discloses a bag 10 having the valve 12 constructed in accordance with the teachings of the present invention adapted to be sealed to the upper peripheral edge 14 that defines open end 18 of bag 10. Bag 10 also has a closed bottom end 16.

Bag 10 may be formed in a number of different ways and preferably consists of a polyethylene flexible member that has its peripheral edges heat sealed to each other along the sides and the bottom to define a substantially circular sleeve that has a closed end 16 and an upper open end 18. Alternatively, the bag could be formed by taking a single member and doubling the member upon itself so that the lower edge 16 is produced by a fold intermediate opposite ends of the single member and the opposite peripheral edges sealed to each other to produce the bag. Of course, two flexible members of identical construction could also be utilized to make the bag by sealing the opposite marginal edges and the lower edges of the two members.

According to the present invention, a unique valve is constructed from two flexible members, preferably polyethylene, of substantially identical configuration to produce a valve portion 20 and a support portion 22. The valve portion is formed by sealing the two marginal edges 24 of a portion of two members 26 and 28 to produce a valve having an inlet opening 30 and an outlet opening 32. In the embodiment illustrated in FIG. 2, the sealed peripheral edges merge toward each other and are generally arcuate so that the inlet opening 30 is substantially equal to the maximum width of members 26 and 28 and is located substantially intermediate opposite ends thereof.

Figure 1:
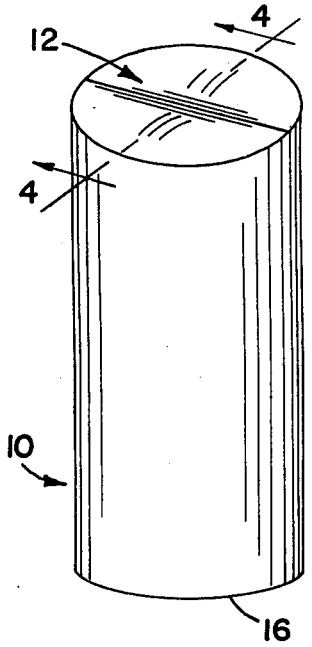
FIG. 1 shows a fragmentary portion of a flexible bag having a flexible one-way valve constructed in accordance with the present invention.

Thus, the opening 30 is substantially equal to the diameter of the unattached portions which are preferably circular and are adapted to be sealed to the upper open peripheral edge 14 of the bag. In its assembled condition, valve 12 has its support portion 22 extending substantially perpendicular to the axis of the sleeve or bag 10 while the valve portion 20 extends parallel to the axis and diametrically across the circular support portion 22. With the support portion 22 sealed to the peripheral edge of bag 10, as illustrated in FIG. 1, the support portion can expand to conform generally to the periphery of the opening 18 when the bag is in a filled condition.

The advantages of such an arrangement are numerous. For example, the support portion 22 of the bag is capable of expanding as a direct function of the amount of material being placed into the bag so that there is no force perpendicular to the peripheral edges that define inlet opening 30 as the bag is filled and expanded.

Figure 4:
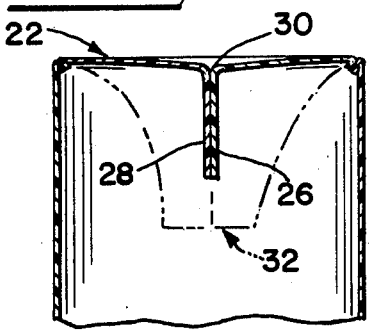
FIG. 4 is a cross-sectional view as viewed generally along line 4—4 of FIG. 1.

Another advantage of the unique valve construction is the fact that when the bag 10 is partially filled, the bag with the unique valve attached thereto can be inverted and the valve will remain closed. This is because the support portion 22 is adapted to expand and extend perpendicularly across the open end of the bag while the valve will remain in the closed position illustrated in FIG. 4.

According to one aspect of the invention, the valve portion 20 of valve 12 is substantially equal to one-half the diameter of the support portion defined by unattached portions of members 26 and 28.

The unique valve 12 can easily be constructed with a minimum amount of material and can readily be attached to the peripheral edge of the bag 10. For example, two pieces of pliable material, such as plastic cloth, paper, rubber, polyethylene or other preferably heat sealable material are superimposed upon each other and have peripheral edges of identical configuration. The adjacent peripheral edges of the two members are then heat sealed to each other from one end toward the opposite end and the heat sealed portions terminate intermediate opposite ends of the two members. Thus, the remaining unattached portions of the two members can then extend perpendicular to the valve portion to define a support portion that extends perpendicular to the valve portion.

Figure 3:
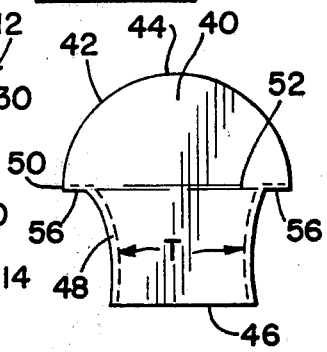
FIG. 3 is a plan view of a modified form of one-way valve.

A slightly modified form of the invention is illustrated in FIG. 3 and again consists of two flexible members 40 that have peripheral edges 42 of identical configuration and have opposite ends 44 and 46. The edge portions that define the end 46 preferably extend perpendicular to a plane between opposite ends 44 and 46 and the sealed peripheral edges 48 extend from end 46 to an intermediate portion 50 of the two members 40. As illustrated in FIG. 3, the sealed peripheral edges are generally arcuate and define a maximum opening 52 adjacent the support portion of the bag with the sealed edges having outwardly directed portions 56 extending away from the valve inlet opening 52. It should also be noted that the outlet opening defined between edges 46 is shown in the drawing as slightly smaller than the inlet opening 52, but this difference is not important in the operation of the invention. However, the reduced intermediate throat portion T formed between the inlet and the outlet is smaller than either opening 52 or 46 and this is significant. Again the valve portion of the member shown in FIG. 3 is substantially half the distance between opposite ends 44 and 46. Thus, when the unattached portion of the members 40 are positioned perpendicular or along the plane that extends perpendicular to the axis of the valve, the unattached portions will define a support portion which extends substantially perpendicular to the valve and the valve is located along the diametric center of the support portion.

Figure 6:
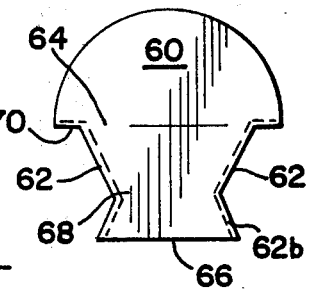
FIG. 6 is a view similar to FIG. 3 showing a further modified form of valve construction.

A further modified form of the invention is illustrated in FIG. 6 and is very similar to the embodiment illustrated in FIG. 3. Again, two members 60 of identical configuration and preferably having heat sealing capabilities, have peripheral edge portions 62 sealed into each other to produce a valve that has an inlet opening 64 and an outlet opening 66. The sealed marginal edges 62 preferably taper towards each other a portion of the distance from inlet 64 to outlet 66 identified by reference number 62*a*, and then taper away from each other as illustrated by 62*b* in FIG. 6 to produce a reduced throat portion 68 that has a width less than the width of the inlet opening 64 and the outlet opening 66. Again, in this version of the invention, the sealed peripheral edges also have end portions 70 that extend outwardly from the inlet opening 64 so that the inlet opening 64 of the valve is spaced from the peripheral edge of the unattached portions that define the support portion of the valve.

Figure 5:
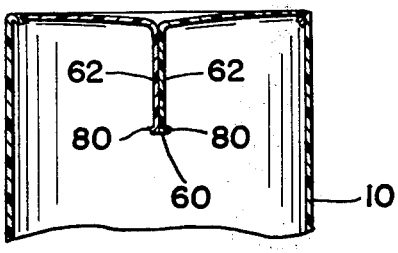
FIG. 5 is a view similar to FIG. 4 showing a slightly modified form of valve.

In all embodiments of the invention, the sealing capability of the outlet opening 66 can be increased by providing integral enlarged portions 80 on the lower edges that define outlet opening 60, as illustrated in FIG. 5.

In summary, the unique valve construction eliminates the problems of prior art type valve constructions for flexible bags, such as shown in FIG. 7. For example, with a separate support portion for the valve which has the same dimensions as the bag opening, the valve will remain in the closed position even when the bag is partially or totally filled and inverted because the support portion will still accommodate expansion of the inverted bag while the valve will remain in a closed condition.

In the embodiment illustrated in FIGS. 3 and 6, the unique configuration of the valve, particularly the reduced throat portion between the inlet and the outlet, eliminates the problem of the valve inverting when the bag is inverted such as occurs in utilizing a valve construction such as shown in FIG. 7. In addition, the amount of material needed for producting the valve is minimized and therefore reduces the overall cost for making the completed bag, which is a significant cost savings over the prior art type of valve illustrated in FIG. 8. The valves constructed according to the present invention also have a large inlet opening to receive either solid or liquid materials when compared with the valve illustrated in FIG. 9. The unique valves will also allow the bag to be filled substantially to its capacity as a result of the short distance between the inlet and the outlet. For solid materials the distance could be shorter and for liquids it could be made longer.

The valves of the present invention can be made with a minimum amount of material, equipment and labor so that the overall cost is minimal. Furthermore, the valves can easily be produced for any size of bag.

I claim:

1. In a flexible one-way valve of the type incorporated into the open end of a distensible bag, said valve formed from two flexible members having identical peripheral configurations and adhered along selected edges to form a planar valve support and a valve portion depending from and perpendicularly disposed to said valve support, said valve being seated in said open end by adhering peripheral edges of said support to peripheral edges of said open end, the improvement comprising:

a valve portion having an inlet of maximum width and an outlet, said valve portion having opposing sealed peripheral edges tapering inward to define a substantially intermediately positioned throat, said throat having a width lesser than either said inlet or said outlet and said opposing edges tapering outward from said throat to said outlet, whereby said throat in said valve portion prevents outward displacement of said valve portion upon inversion of said bag.

2. The flexible one-way valve described in claim 1, wherein said opposing edges inwardly arc from said inlet to said throat and outwardly arc from said throat to said outlet.

3. The flexible one-way valve described in claim 1, wherein said opposing edges linearly indent inward from said inlet for a selected distance beyond the intermediate position on said valve portion thereby to define a reduced throat and linearly flare outward from said throat to said outlet.

4. The flexible one-way valve described in any of claims 1, 2 or 3 in which the peripheral edges of said outlet are provided with outwardly protruding linear beading to enhance sealability of said outlet.

5. The flexible one-way valve in any of claims 1, 2 or 3 wherein said valve support is substantially circular and said valve portion has a length approximately equal to the radius of said circular valve support.

* * * * *